US010100576B1

(12) United States Patent
Dimovski

(10) Patent No.: US 10,100,576 B1
(45) Date of Patent: Oct. 16, 2018

(54) UNDERGRATE STAIRWAY ACCESS ASSEMBLY

(71) Applicant: Edward Dimovski, Tottenham (CA)

(72) Inventor: Edward Dimovski, Tottenham (CA)

( * ) Notice: Subject to any disclaimer, the term of this patent is extended or adjusted under 35 U.S.C. 154(b) by 130 days.

(21) Appl. No.: 15/257,097

(22) Filed: Sep. 6, 2016

(51) Int. Cl.

| | |
|---|---|
| ***E04F 11/04*** | (2006.01) |
| ***E06C 1/34*** | (2006.01) |
| ***E04F 11/06*** | (2006.01) |
| ***E04F 11/18*** | (2006.01) |
| ***E06C 7/48*** | (2006.01) |

(52) U.S. Cl.
CPC ..... *E06C 1/34* (2013.01); *E04F 11/062* (2013.01); *E04F 11/1865* (2013.01); *E06C 7/48* (2013.01)

(58) Field of Classification Search
CPC . Y10S 256/06; E02D 29/127; E04D 13/0335; E06C 7/181; E06C 7/182; E06C 9/00; E06C 9/10; E06C 1/393; E04F 11/062; E04F 11/1865; E04F 11/18; E04F 11/1808; E04F 2011/1868; E04G 21/3228; E04G 21/3233; E04G 21/32; E04G 21/3204; E04G 21/3214; E04G 21/3223
See application file for complete search history.

(56) References Cited

U.S. PATENT DOCUMENTS 1,654,073 A 12/1927 Fagan
2,389,899 A * 11/1945 Deddo ..... E04B 1/34384 182/228.1
2,840,289 A * 6/1958 Murray ..... E06C 1/56 182/196
3,193,851 A * 7/1965 Fiebelkorn ..... B60F 3/0061 114/344
3,693,754 A * 9/1972 Butler ..... E04F 11/062 182/113
3,807,528 A * 4/1974 Frank ..... E04D 13/035 182/81
3,837,427 A * 9/1974 Mattinson ..... E04G 1/14 182/115
4,068,738 A * 1/1978 Reed ..... B63C 5/02 182/128
4,188,985 A 2/1980 Osterman
4,284,173 A 8/1981 Patterson
5,067,587 A * 11/1991 Mims, Jr. ..... B66F 11/04 182/131
5,239,795 A 8/1993 Breaux
(Continued)

FOREIGN PATENT DOCUMENTS

CN 203361497 U 12/2013

*Primary Examiner* — Daniel P Cahn
(74) *Attorney, Agent, or Firm* — Kyle A. Fletcher, Esq.

(57) ABSTRACT

The undergrate stairway access assembly is a portable stairway designed to provide safe access to different levels through temporary openings in supporting surfaces such as floors and sidewalks. Specifically, the undergrate stairway access assembly is an assembly comprising an integrated guardrail and step structure that allows a worker to safely traverse between different levels through openings in the supporting surface while preventing workers from inadvertently falling through these openings. The undergrate stairway access assembly is ideal for providing protection for projects that require the removal of grated surface protections such as sidewalk grates, sewage grates or undercarriage bays. The undergrate stairway access assembly comprises one or more step structures and a guardrail structure.

13 Claims, 6 Drawing Sheets

(56) References Cited

U.S. PATENT DOCUMENTS

D344,594 S 2/1994 Whitney
5,282,339 A * 2/1994 Devlin ..... E02D 29/12 182/106
5,701,706 A 12/1997 Kreysler
5,941,024 A * 8/1999 Journault ..... E02D 29/12 182/112
6,272,800 B1 * 8/2001 Phinney ..... E04D 13/0335 182/112
6,467,230 B1 * 10/2002 Perkins ..... E04F 11/1812 248/220.1
6,539,678 B1 4/2003 Campbell
6,830,127 B2 * 12/2004 Johnson ..... E02D 29/12 182/113
7,077,239 B1 * 7/2006 Hayman ..... E04G 1/15 182/178.1
D620,131 S * 7/2010 Ray ..... D25/48.3
8,272,477 B1 9/2012 Hudspeth
8,555,555 B2 * 10/2013 Cardwell ..... E02D 29/12 105/377.06
8,702,069 B1 * 4/2014 Byers ..... E04F 11/1812 256/65.14
8,931,792 B1 * 1/2015 Klassen ..... B60R 3/02 182/65.1
9,045,906 B1 * 6/2015 Richey ..... E04D 13/0357
9,745,777 B2 * 8/2017 Whiting ..... E05B 47/02
2002/0153201 A1 * 10/2002 Warford ..... E04F 11/025 182/115
2003/0167701 A1 * 9/2003 Rich ..... E04B 1/003 52/79.6
2003/0208965 A1 * 11/2003 Perkins ..... E02D 29/127 52/19
2004/0154241 A1 * 8/2004 Joyce ..... E04D 13/0315 52/200
2005/0077107 A1 * 4/2005 Libert ..... E04G 1/15 182/119
2006/0278472 A1 * 12/2006 Kenton ..... E04G 21/3233 182/113
2007/0051559 A1 * 3/2007 Brown ..... B66F 11/042 182/63.1
2008/0116018 A1 * 5/2008 Wieland ..... A63G 31/12 187/401
2010/0031573 A1 * 2/2010 Whiting ..... E05B 47/02 49/31
2011/0017967 A1 * 1/2011 Whiting ..... E04D 13/0335 256/59
2015/0034420 A1 * 2/2015 Watson ..... E04G 1/152 182/222
2016/0159613 A1 * 6/2016 MacDonald ..... E06B 5/01 187/245
2017/0226803 A1 * 8/2017 Russell ..... E06C 1/393
2017/0241204 A1 * 8/2017 Moss ..... E06O 7/182
2017/0321452 A1 * 11/2017 Whiting ..... E04B 7/16

* cited by examiner

UNDERGRATE STAIRWAY ACCESS ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of scaffolding and stairways, more specifically, a temporary arrangement for giving access from one level to another.

SUMMARY OF INVENTION

The undergrate stairway access assembly is a portable stairway designed to provide safe access to different levels through temporary openings in supporting surfaces such as floors and sidewalks. Specifically, the undergrate stairway access assembly is an assembly comprising an integrated guardrail and step structure that allows a worker to safely traverse between different levels through openings in the supporting surface while preventing workers from inadvertently falling through these openings. The undergrate stairway access assembly is ideal for providing protection for projects that require the removal of grated surface protections such as sidewalk grates, sewage grates or undercarriage bays.

These together with additional objects, features and advantages of the undergrate stairway access will be readily apparent to those of ordinary skill in the art upon reading the following detailed description of the presently preferred, but nonetheless illustrative, embodiments when taken in conjunction with the accompanying drawings.

In this respect, before explaining the current embodiments of the undergrate stairway access in detail, it is to be understood that the undergrate stairway access is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the undergrate stairway access.

It is therefore important that the claims be regarded as including such equivalent construction insofar as they do not depart from the spirit and scope of the undergrate stairway access. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
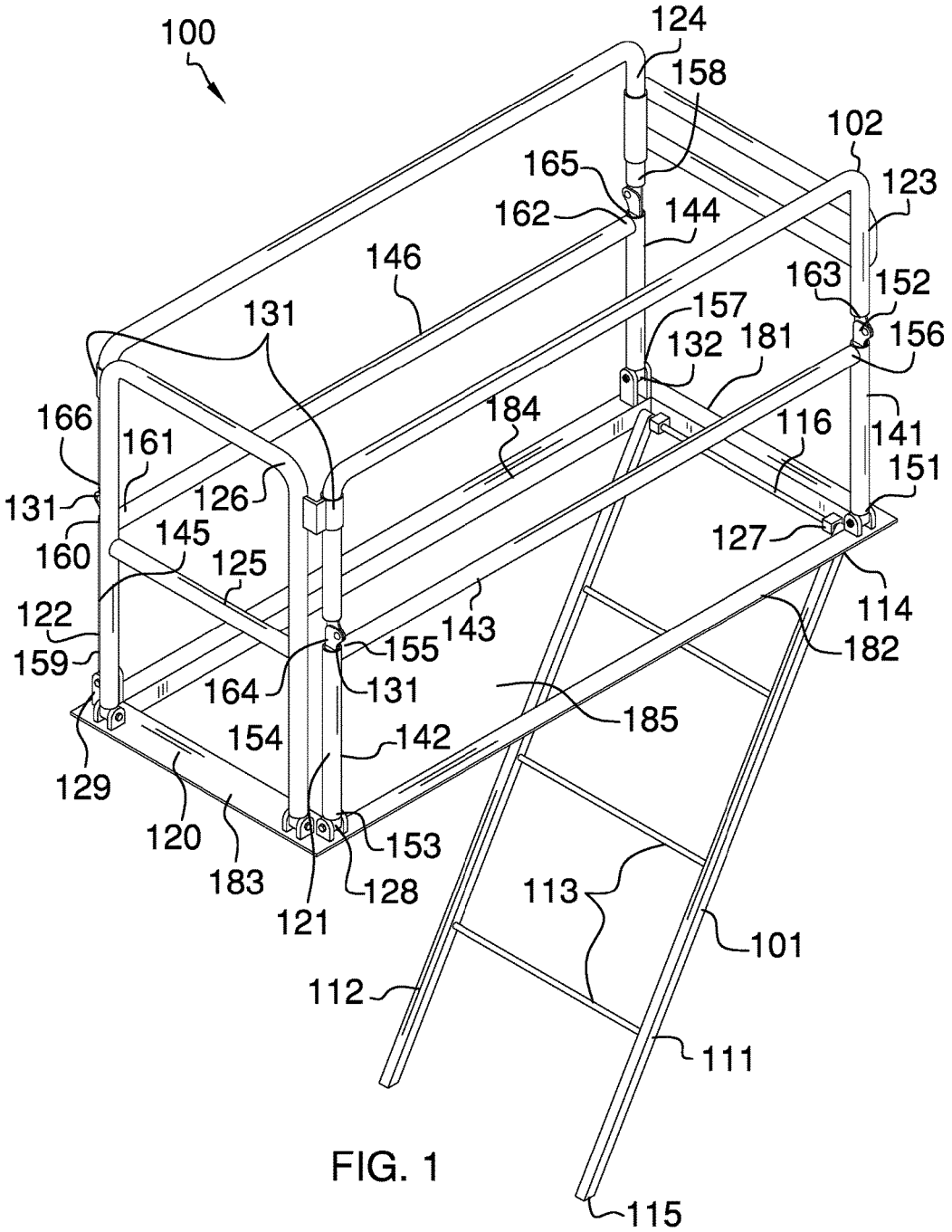
FIG. 1 is a perspective view of an embodiment of the disclosure.
Figure 2:
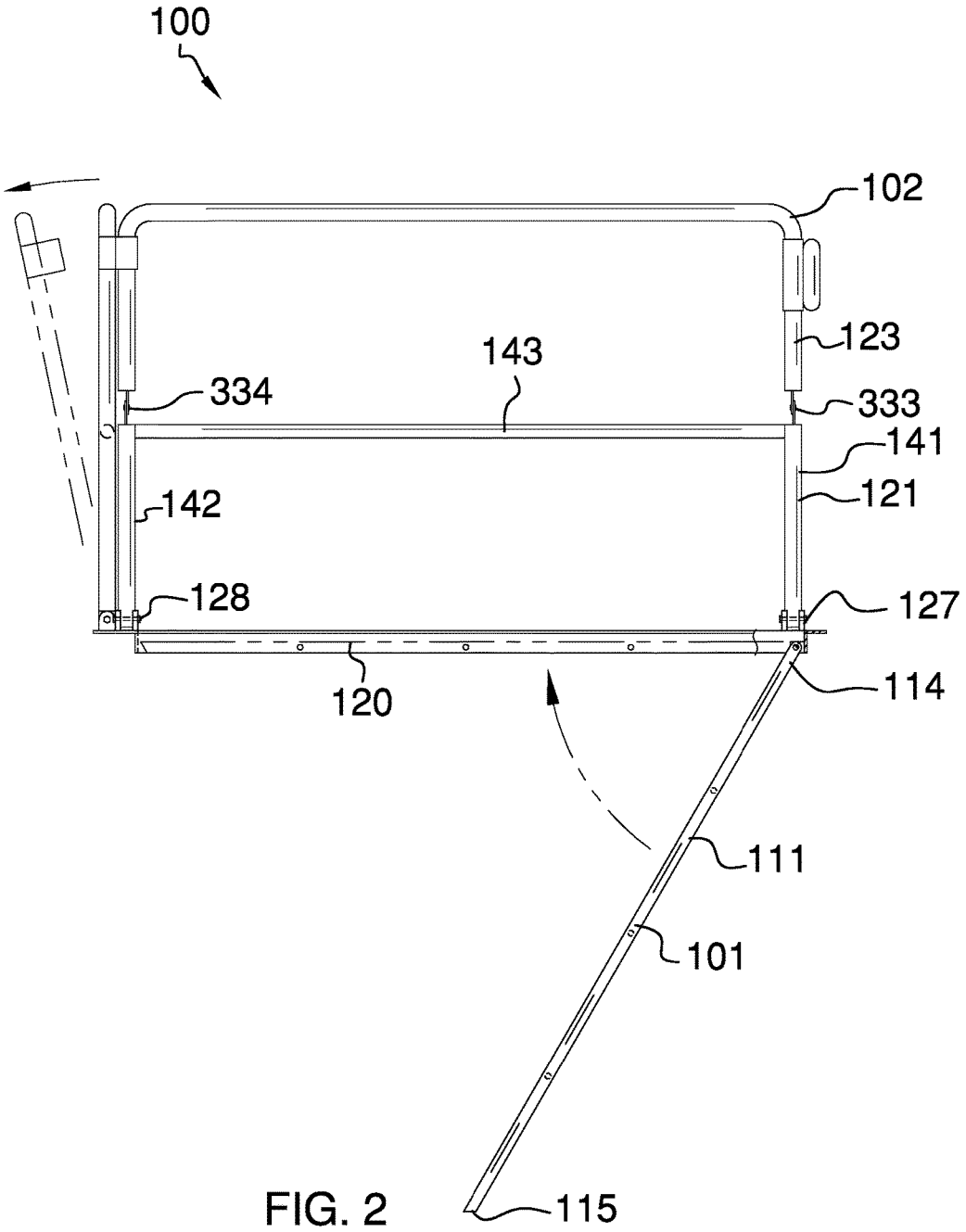
FIG. 2 is a side view of an embodiment of the disclosure.
Figure 3:
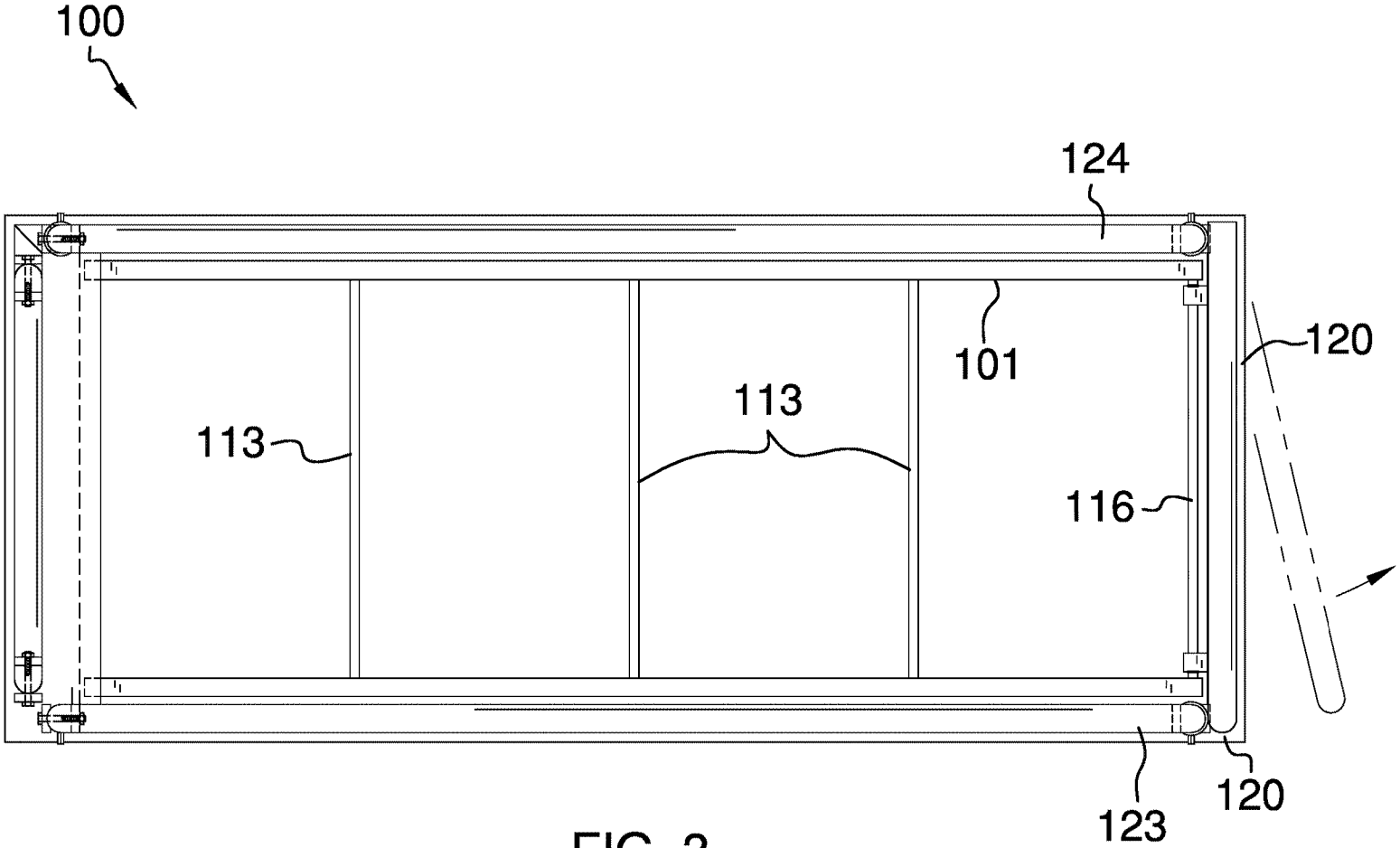
FIG. 3 is a top view of an embodiment of the disclosure.
Figure 4:
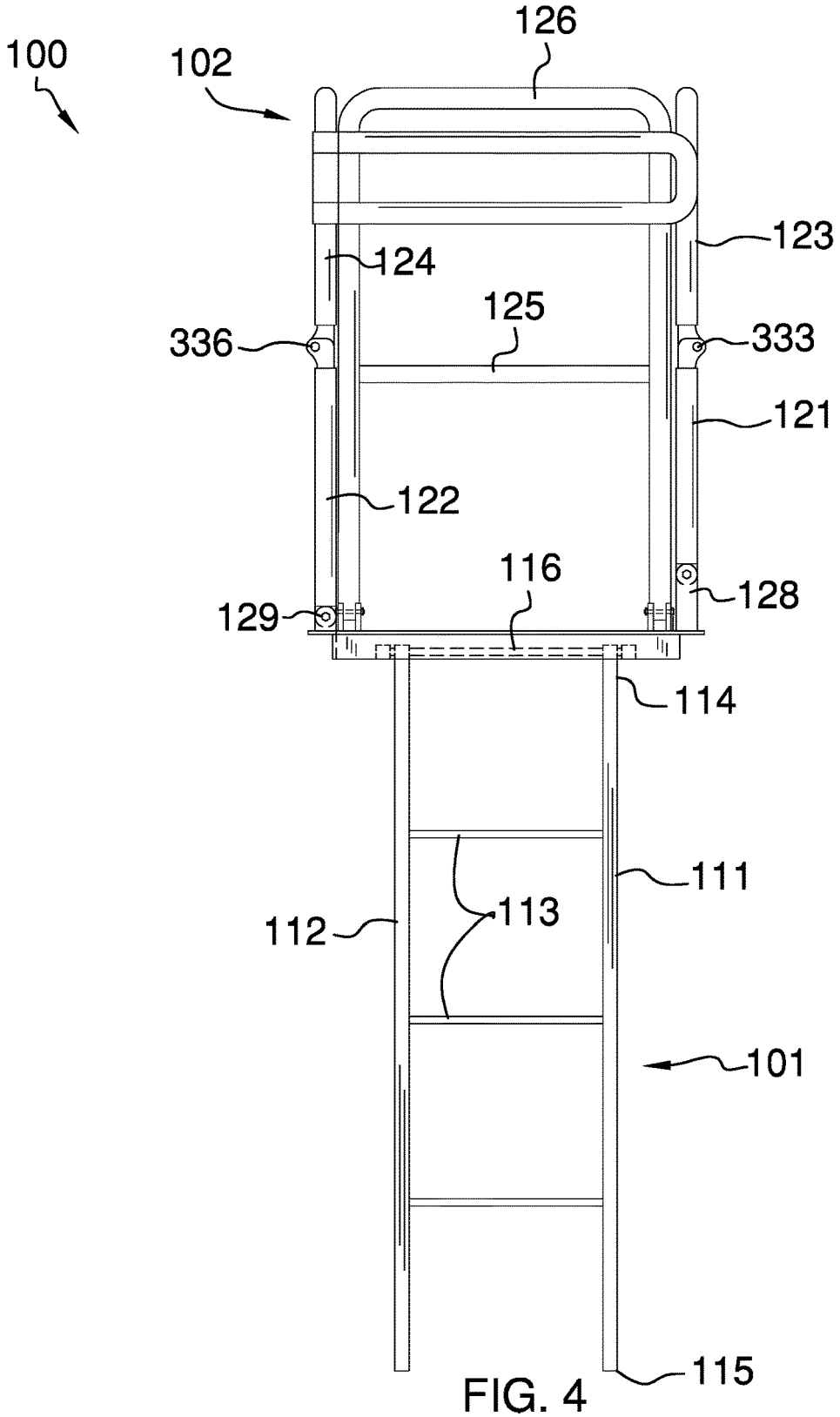
FIG. 4 is a front view of an embodiment of the disclosure.
Figure 5:
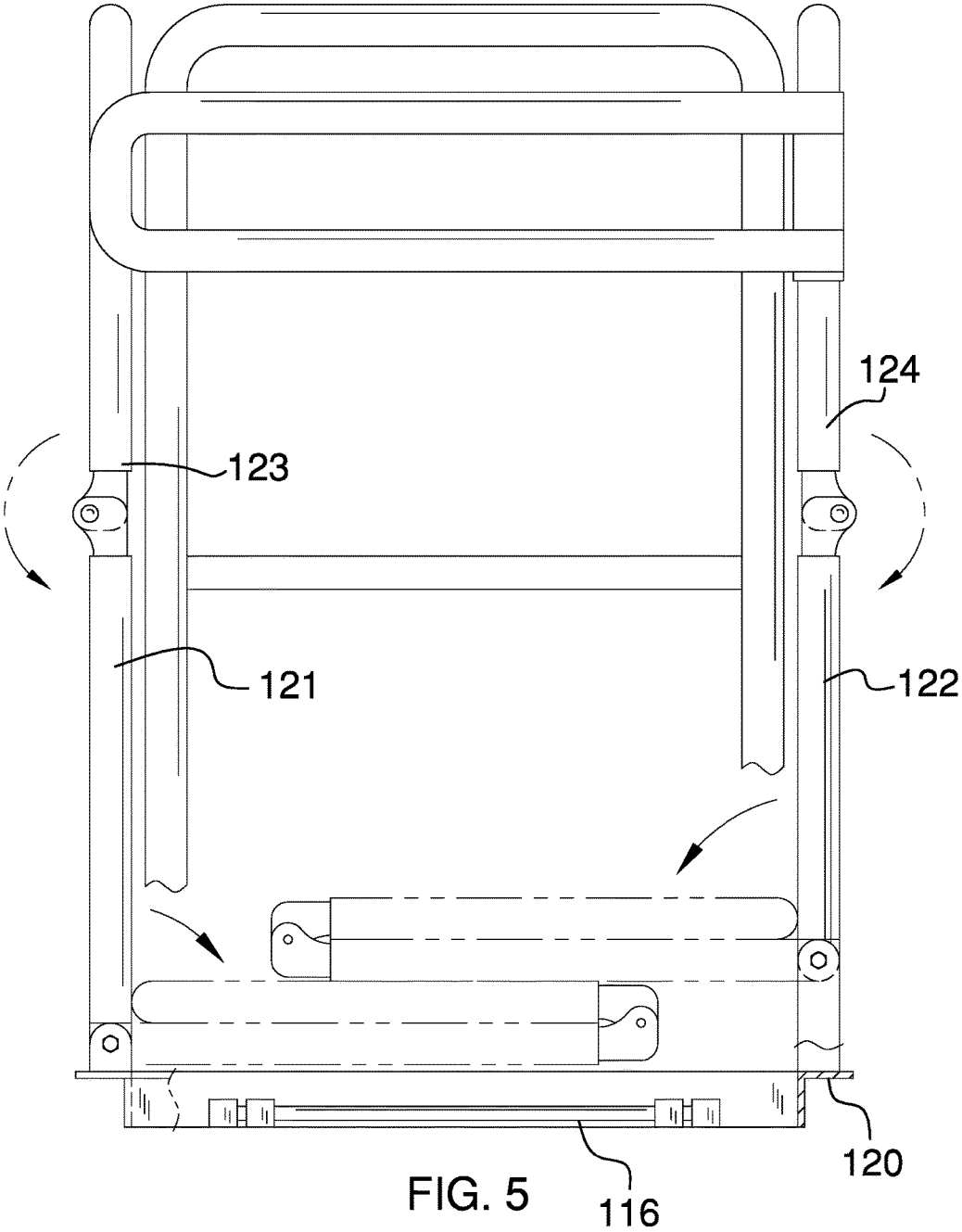
FIG. 5 is an operating view of an embodiment of the disclosure.

The following detailed description is merely exemplary in nature and is not intended to limit the described embodiments of the application and uses of the described embodiments. As used herein, the word "exemplary" or "illustartive" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6.

The undergrate stairway access assembly 100 (hereinafter invention) comprises one or more step structures 101 and a guardrail structure 102. The invention 100 is a portable stairway designed to provide safe access to different levels through temporary openings in supporting surfaces 500 such as floors and sidewalks. Specifically, the invention 100 is an assembly comprising an integrated guardrail and step structure that allows a worker to safely traverse between different levels through openings 501 in the supporting surface 500 while preventing workers from inadvertently falling through these openings. The invention 100 provides projection for projects that require the removal of grated surface protections such as sidewalk grates, sewage grates or undercarriage bays.

The guardrail structure 102 comprises a base structure 120, a first guard 121, a second guard 122, a third guard 123, a fourth guard 124, a first crossbar 125, a second crossbar 126, a first hinge 127, a second hinge 128, a third hinge 129, a fourth hinge 130, and a plurality of brackets 131.

The base structure 120 is a flat rectangular structure made of plate metal with a hollow center 185. The base structure 120 is placed on the supporting surface 500 around the surface opening through which workers will be traversing. The base structure 120 further comprises a first strip 181, a second strip 182, a third strip 183 and a fourth strip 184.

The first guard 121 is a U shaped structure that is formed from hollow metal tubes. The first guard 121 further comprises a first metal tube 141, a second metal tube 142, and a third metal tube 143. The first metal tube 141 is further defined with a first end 151 and a second end 152. The second metal tube 142 is further defined with a third end 153 and a fourth end 154. The third metal tube 143 is further defined with a fifth end 155 and a sixth end 156. As shown most clearly in FIG. 1, the first end 151 is attached to the second strip 182 using the first hinge 127. The third end 153 is attached to the second strip 182 using the second hinge 128. The sixth end 156 is joined to the second end 152. The fifth end 155 is joined to the fourth end 154. The first hinge 127 and the second hinge 128 are installed such that the first guard 121 will rotate towards the hollow center 185 of the base structure 120. This rotation allows the invention 100 to be collapsed for storage when not in use.

The second guard 122 is a U shaped structure that is formed from hollow metal tubes. The second guard 122 further comprises a fourth metal tube 144, a fifth metal tube 145, and a sixth metal tube 146. The fourth metal tube 144 is further defined with a seventh end 157 and an sixteenth end 166. The fifth metal tube 145 is further defined with a ninth end 159 and a tenth end 160. The sixth metal tube 146 is further defined with an eleventh end 161 and a twelfth end 162. As shown most clearly in FIG. 1, the seventh end 157 is attached to the fourth strip 184 using the fourth hinge 130. The ninth end 159 is attached to the fourth strip 184 using the third hinge 129. The twelfth end 162 is joined to the sixteenth end 166. The eleventh end 161 is joined to the tenth end 160. The third hinge 129 and the fourth hinge 130 are installed such that the second guard 122 will rotate towards the hollow center 185 of the base structure 120. This rotation allows the invention 100 to be collapsed for storage when not in use.

The third guard 123 is a U shaped structure that is formed from a single hollow metal tube that is bent into the U shape. The outer diameter of the third guard 123 is less than the inner diameter of the first metal tube 141. The outer diameter of the third guard 123 is less than the inner diameter of the second metal tube 142. The third guard 123 is further defined with a thirteenth end 163 and a fourteenth end 164. The fourth guard 124 is a U shaped structure that is formed from a single hollow metal tube that is bent into the U shape. The outer diameter of the fourth guard 124 is less than the inner diameter of the fourth metal tube 144. The outer diameter of the fourth guard 124 is less than the inner diameter of the fifth metal tube 145. The fourth guard 124 is further defined with a fifteenth end 165 and a sixteenth end 166.

The first crossbar 125 is a hollow metal tube. Each of the plurality of brackets 131 is a metal hardware shaft. Each of the plurality of brackets 131 are used to temporarily join a first element of the guardrail structure 102 to a second element of the guardrail structure 102 while the invention 100 is in use. The use of the first crossbar 125, and the plurality of brackets 131 are described in detail elsewhere in this disclosure. Methods to attach metal tubes to each other through the use of pins are well known and documented in mechanical arts.

Each of the one or more step structures 101 comprises a first stringer 111, a second stringer 112, a plurality of treads 113, a first terminus 114, a second terminus 115, and a pivot bar 116. The first stringer 111 is a structural metal piece that runs parallel to the second strip 182 and the fourth strip 184. The first stringer 111 is joined to each of the plurality of treads 113 such that the first stringer 111 will support each of the plurality of treads 113 when a tread selected from the plurality of treads 113 is placed under a load. The second stringer 112 is a structural metal piece that runs parallel to the second strip 182 and the fourth strip 184. The second stringer 112 is joined to each of the plurality of treads 113 such that the second stringer 112 will support each of the plurality of treads 113 when a tread selected from the plurality of treads 113 is placed under a load. Each of the plurality of treads 113 is a structural metal piece that runs parallel to the first strip 181 and the third strip 183. Each of the plurality of treads 113 is joined to the first stringer 111 and the second stringer 112 such that the first stringer 111 and the second stringer 112 will support any tread contained within the plurality of treads 113 that is placed under a load. Each of the one or more step structures 101 is further defined by a first terminus 114 and a second terminus 115.

As shown most clearly in FIG. 1, the first terminus 114 of the first step structure selected from the one or more step structures 101 is attached to the base structure 120 using the pivot bar 116. The pivot bar 116 is a cylindrical metal shaft that attaches the first terminus 114 to the second strip 182 and the fourth strip 184 such that the first step structure selected from the one or more step structures 101 is attached to the base structure 120 using the pivot bar 116. The first step structure selected from the one or more step structures 101 is attached to the base structure 120 such that the first step structure can rotate into and out of the hollow center 185. When more than one step structure is included within the one or more step structures 101, the first terminus 114 of the second and subsequent step structures are attached to the second terminus 115 of the prior step structure using the pivot bar 116 in a manner analogous to the manner described above.

The assembly of the invention 100 for use is described in this paragraph and the next paragraph. As shown most clearly in FIG. 1, the base structure 120 is placed on a supporting surface such that the hollow center 182 is placed over the opening in the supporting surface. The first guard 121 is rotated around the first hinge 127 and the second hinge 128 such that the first guard 121 projects away from the base structure 120 in direction perpendicularly away from the supporting surface. The first guard 121 is locked in position using one of the plurality of brackets 131. The second guard 122 is rotated around the third hinge 129 and the fourth hinge 130 such that the second guard 122 projects away from the base structure 120 in a direction perpendicularly away from the supporting surface. The second guard 122 is locked in position using one of the plurality of brackets 131. The thirteenth end 163 of the third guard 123 is inserted into the second end 152 of the first metal tube 141 and is locked in position using one of the plurality of brackets 131. The fourteenth end 164 of the third guard 123 is inserted into the fourth end 154 of the second metal tube 142 and is locked in position using one of the plurality of brackets 131. The fifteenth end 165 of the fourth guard 124 is inserted into the sixteenth end 166 of the fourth metal tube 144 and is locked in position using one of the plurality of brackets 131. The sixteenth end 166 of the fourth guard 124 is inserted into the tenth end 160 of the fifth metal tube 145 and is locked in position using one of the plurality of brackets 131. The first crossbar 125 attaches to the second metal tube 142 and the fourth metal tube 144 using one of the plurality of brackets 131.

The first crossbar 125 is positioned directly above the third strip 183. The first crossbar 125 is rotatably affixed to the third strip 183 via a pair of first crossbar hinges 444. The pair of first crossbar hinges 444 enable the first crossbar 125 to rotate outwardly with respect to the invention 100 as needed. Each of the one or more step structures 101 is rotated into the opening of the support surface to provide a step structure that allows workers to safely traverse levels.

The second crossbar 126 is rotatable affixed to the fourth guard 124. The second crossbar 126 includes a second crossbar pipe 477. The second crossbar pipe 477 is positioned over a portion of the fourth guard 124 in order for the second crossbar 126 to rotate relative thereto.

The first metal tube 141 is joined to the third guard 123 via a first hinge 333. The second metal tube 142 is joined to the third guard 123 via a second hinge 334. The first hinge 333 and the second hinge 334 enable the third guard 123 to be able to rotate outwardly with respect to the invention 100 (see FIG. 5). The third metal tube 143 is joined to the fourth guard 124 via a third hinge 335. The fourth metal tube 144 is joined to the fourth guard 124 via a fourth hinge 336. The third hinge 335 and the fourth hinge 336 enable the fourth guard 124 to be able to rotate outwardly with respect to the invention 100 (see FIG. 5).

Figure 6:
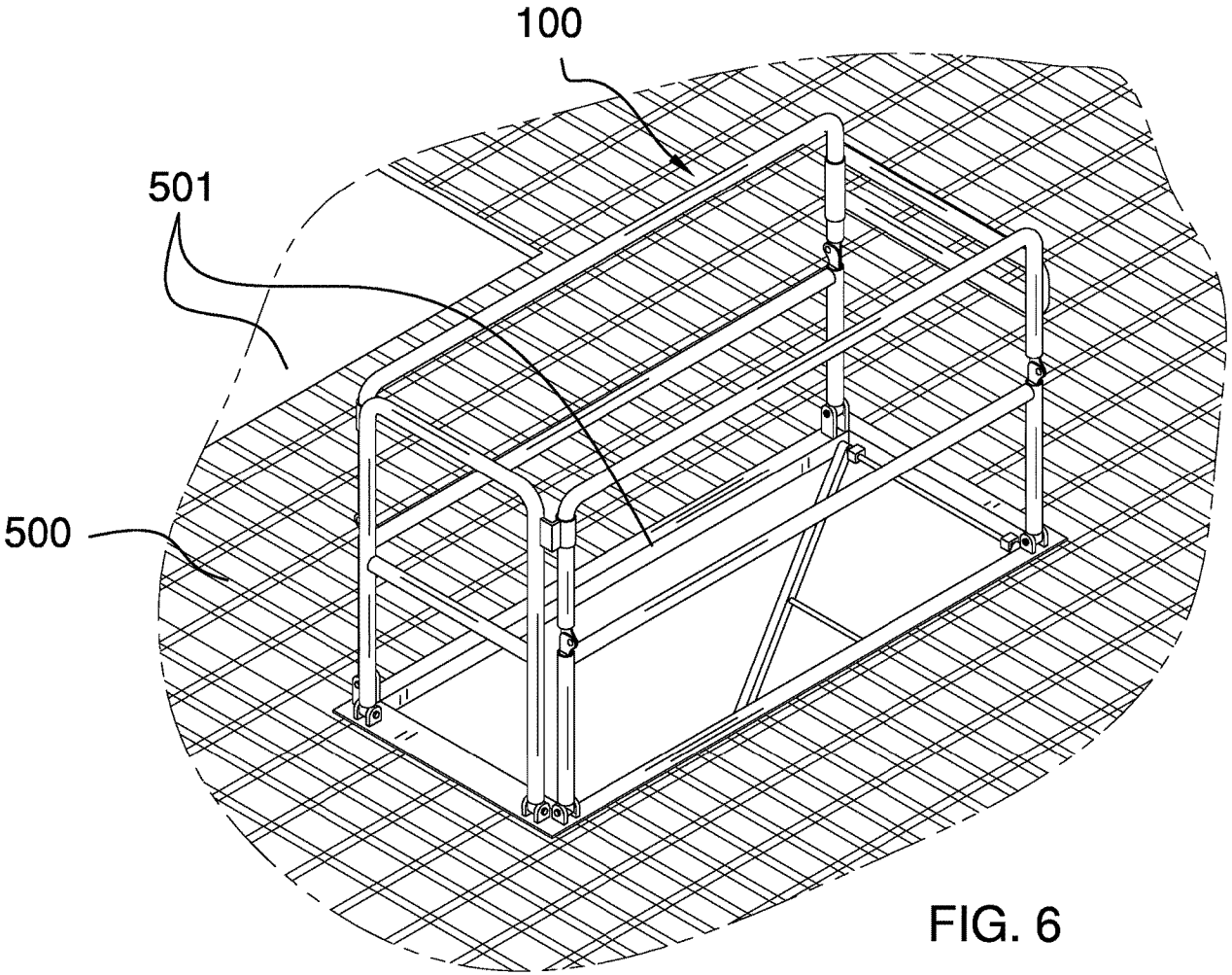
FIG. 6 is a perspective view of an embodiment of the disclosure in use.

Referring to FIG. 6, the invention 100 is depicted in use with the supporting surface 500. Moreover, the opening 501 in the supporting surface 500 is adapted to interface with the invention 100, thereby enabling a person to safely traverse between the supporting surface 500 and a lower level. It shall be noted that the supporting surface 500 is ideally constructed with a metal grate flooring, which is commonly used in industrial settings.

To prepare the invention 100 for transportation and storage, the sequence of events described in the above paragraph is reversed.

All the components described in this disclosure are made of metal suitable for structural and load bearing uses. Suitable metals include, but are not limited to, iron, steel, and aluminum. Unless otherwise noted within the disclosure, any first element described in this disclosure that is joined to a second element described in this disclosure is joined by welding.

The following definitions were used in this disclosure:

Hinge: As used in this disclosure, a hinge is a device that permits the turning, rotating, or pivoting of a first object relative to a second object.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Pivot: As used in this disclosure, a pivot is a rod or shaft around which an object rotates or swings.

Strip: As used in is disclosure, the term describes a long and narrow object of uniform thickness that appears thin relative to the length of the object. Strips re often rectangular in shape.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable stairway comprising:

one or more step structures and a guardrail structure;

wherein the portable stairway is adapted for use with an opening in a supporting surface;

wherein the portable stairway is configured to allow a person to safely traverse between different levels through the opening in the supporting surface;

wherein the portable stairway is configured to prevent a person from falling through the opening in the supporting surface;

wherein the guardrail structure comprises a base structure, a first guard, a second guard, a third guard, a fourth guard, a first crossbar, a second crossbar, a first hinge, a second hinge, a third hinge, a fourth hinge, and a plurality of brackets;

wherein the base structure is a flat rectangular structure with a hollow center;

wherein the base structure further comprises a first strip, a second strip, a third strip and a fourth strip;

wherein the first guard is a U shaped structure;

wherein the second guard is a U shaped structure;

wherein the first guard further comprises a first metal tube, a second metal tube, and a third metal tube;

wherein the second guard further comprises a fourth metal tube, a fifth metal tube, and a sixth metal tube;

wherein the first metal tube is further defined with a first end and a second end;

wherein the second metal tube is further defined with a third end and a fourth end;

wherein the third metal tube is further defined with a fifth end and a sixth end;

wherein the fourth metal tube is further defined with a seventh end and an eighth end;

wherein the fifth metal tube is further defined with a ninth end and a tenth end;

wherein the sixth metal tube is further defined with an eleventh end and a twelfth end;

wherein the first end is attached to the second strip using the first hinge;

wherein the third end is attached to the second strip using the second hinge;

wherein the ninth end is attached to the fourth strip using the third hinge;

wherein the seventh end is attached to the fourth strip using the fourth hinge;

wherein the sixth end is joined to the second end;

wherein the fifth end is joined to the fourth end;

wherein the twelfth end is joined to the eighth end;

wherein the eleventh end is joined to the tenth end;

wherein the first hinge and the second hinge are installed such that the first guard will rotate towards the hollow center of the base structure;

wherein the third hinge and the fourth hinge are installed such that the second guard will rotate towards the hollow center of the base structure;

wherein the third guard is a U shaped structure that is formed from a single hollow metal tube;

wherein the fourth guard is a U shaped structure that is formed from a single hollow metal tube;

wherein the third guard is further defined with a thirteenth end and a fourteenth end;

wherein the fourth guard is further defined with a fifteenth end and a sixteenth end;

wherein an outer diameter of the third guard is less than an inner diameter of the first metal tube;

wherein the outer diameter of the third guard is less than the inner diameter of a second metal tube;

wherein an outer diameter of the fourth guard is less than an inner diameter of the fourth metal tube;

wherein the outer diameter of the fourth guard is less than an inner diameter of the fifth metal tube;

wherein each of the one or more step structures comprises a first stringer, a second stringer, a plurality of treads, a first terminus, a second terminus, and a pivot bar.

2. The portable stairway according to claim 1 wherein the first crossbar is a hollow metal tube;

wherein the second crossbar is a hollow metal tube.

3. The portable stairway according to claim 2 wherein each of the plurality of brackets is a metal shaft.

4. The portable stairway according to claim 1 wherein the first stringer is a metal piece that runs parallel to the second strip and the fourth strip;

wherein the second stringer is a metal piece that runs parallel to the second strip and the fourth strip.

5. The portable stairway according to claim 4 wherein the first stringer is joined to each of the plurality of treads such that the first stringer will support each of the plurality of treads when a tread selected from the plurality of treads is placed under a load;

wherein the second stringer is joined to each of the plurality of treads such that the second stringer will support each of the plurality of treads when a tread selected from the plurality of treads is placed under a load.

6. The portable stairway according to claim 5 wherein each of the plurality of treads is a metal piece that runs parallel to the first strip and the third strip.

7. The portable stairway according to claim 6 wherein the first terminus of a first step structure selected from the one or more step structures is attached to the base structure.

8. The portable stairway according to claim 7 wherein the pivot bar is a cylindrical metal shaft that attaches the first terminus of the one or more step structures to the second strip and the fourth strip.

9. The portable stairway according to claim 8 wherein the first step structure selected from the one or more step structures is attached to the base structure such that the first step structure can rotate into and out of the hollow center.

10. The portable stairway according to claim 9 wherein when more than one step structure is included within the one or more step structures, the first terminus of the second and subsequent step structures are attached to the second terminus of a prior step structure selected from the one or more step structures; wherein the supporting surface is a metal grate flooring.

11. The portable stairway according to claim 10 wherein the first crossbar is positioned directly above the third strip; wherein the first crossbar is rotatably affixed to the third strip via a pair of first crossbar hinges; wherein the pair of first crossbar hinges enable the first crossbar to rotate outwardly with respect to the portable stairway as needed.

12. The portable stairway according to claim 11 wherein the second crossbar is rotatable affixed to the fourth guard; wherein the second crossbar includes a second crossbar pipe; wherein the second crossbar pipe is positioned over a portion of the fourth guard in order for the second crossbar to rotate relative thereto.

13. The portable stairway according to claim 12 wherein the first metal tube is joined to the third guard via a first hinge; wherein the second metal tube is joined to the third guard via a second hinge; wherein the first hinge and the second hinge enable the third guard to be able to rotate outwardly with respect to the portable stairway; wherein the third metal tube is joined to the fourth guard via a third hinge; wherein the fourth metal tube is joined to the fourth guard via a fourth hinge; wherein the third hinge and the fourth hinge enable the fourth guard to be able to rotate outwardly with respect to the portable stairway.

* * * * *